United States Patent [19]

Jandeska, Jr.

[11] Patent Number: 4,618,473

[45] Date of Patent: Oct. 21, 1986

[54] IRON POWDER ARTICLE HAVING IMPROVED TOUGHNESS

[75] Inventor: William F. Jandeska, Jr., Rochester, Mich.

[73] Assignee: General Motors Corporation, Detroit, Mich.

[21] Appl. No.: 745,353

[22] Filed: Jun. 14, 1985

[51] Int. Cl.[4] ..... B22F 1/00

[52] U.S. Cl. ..... 419/11; 419/12; 419/23; 419/38; 419/47; 419/54; 419/60; 75/243; 75/244; 75/247

[58] Field of Search ..... 419/47, 11, 12, 23, 419/38, 54, 60; 75/123 B, 123 K, 125, 128 F, 243, 244, 247

[56] References Cited

U.S. PATENT DOCUMENTS 3,999,952 12/1976 Kondo et al. ..... 419/12

4,327,156 4/1982 Dillon et al. ..... 419/27

*Primary Examiner*—Stephen J. Lechert, Jr.

*Attorney, Agent, or Firm*—Douglas D. Fekete

[57] ABSTRACT

A method for forming an iron alloy article having increased toughness comprises compacting and sintering a powder mixture composed of predominantly iron powder and carbon powder and containing a powder of a liquating nickel boride compound. Limited nickel diffusion into the iron structure during sintering produces metastable retained austenite in regions about pores in the product structure that retards crack formation and thereby improves mechanical properties.

3 Claims, No Drawings

IRON POWDER ARTICLE HAVING IMPROVED TOUGHNESS

This invention relates to a powder metallurgical method for manufacturing an iron article by compacting and sintering a predominantly iron powder mixture comprising carbon powder and a powdered liquating intermetallic nickel compound. More particularly, this invention relates to forming an iron powder structure wherein limited nickel diffusion into the iron during sintering produces a retained austenite phase about pores within the structure to improve the mechanical properties thereof.

It is known to produce an iron article by compacting a predominantly iron powder and sintering at a temperature effective to diffusion bond the iron into a cohesive structure. In a typical example, a mixture of iron powder and about 1 weight percent carbon powder is sintered at a temperature of between about 1110° C. and 1120° C., followed by cooling in a nonoxidizing gas. During sintering, the carbon diffuses into the iron to produce a pearlite microstructure. Optionally, a small quantity of copper powder may be added for strengthening by precipitation hardening and enhanced dimensional control. Alternately, the sintered structure may be rapidly quenched, such as with oil or water, to produce a hard martensitic microstructure for increased wear resistance.

Articles produced by iron powder metallurgy comprise pores derived from interparticulate voids within the powder compact. It has been found that the mechanical properties of sintered products are reduced as the result of cracks that form in the metal about the pores. Crack formation may be retarded, and the mechanical properties improved, by adding a suitable agent to form a liquid phase during sintering that coats pore surfaces. However, such liquid phase sintering has not been entirely satisfactory for forming iron products having adequate mechanical properties.

It has also been found that the mechanical properties of predominantly pearlite or ferrite matrix is enhanced by the presence of metastable austenite particles. During deformation, the austenite transforms to martensite, increasing the strain hardening rate. This phenomenon is typically referred to as a transformation-inducted plasticity.

It is an object of this invention to provide a powder metallurgical method for forming an iron structure having improved toughness by compacting and sintering an iron powder in mixture with carbon powder to form predominantly a pearlite or martensite microstructure, which mixture further comprises a suitable intermetallic nickel compound for forming a transient liquid phase during sintering that wets pore surfaces and provides an effective source of nickel for diffusion into the metal about the pore. Upon cooling after sintering, a metastable austenite phase is retained in the nickel-enriched region about the pore. While the bulk structure exhibits desired properties typical of a pearlitic or martensitic iron, the austenite about the pores retards crack initiation and propagation as the result of transformation-induced plasticity and thereby improves mechanical properties.

In accordance with a preferred embodiment of this invention, a method for forming an iron alloy article having improved mechanical properties comprises compacting and sintering a predominantly iron powder mixture containing an effective amount of a liquating intermetallic nickel boride compound. The major portion of the powder mixture is formed of plain iron powder. The mixture also comprises sufficient graphite powder to act as a source of carbon for diffusion into the iron during sintering to produce a hypereutectoid carbon concentration in the product structure. In accordance with this invention, the mixture contains nickel boride particles in an amount sufficient to constitute between about 0.5 and 1.0 weight percent nickel in the product metal. Also, metallic copper powder is preferably added to further enhance mechanical properties and control dimensions.

The product compact is sintered at a temperature preferably between about 1100° C. and 1120° C. During sintering, the iron powder particles become diffusion bonded into a cohesive skeletal structure. The skeletal structure comprises pores derived from interparticle voids within the compact. Carbon from the graphite powder rapidly diffuses into the iron to produce a substantially uniform carbon content throughout the skeleton. Also during sintering, the nickel boride melts to produce a liquid phase that wets the pore surfaces. Nickel and boron diffuse from the liquid into the iron skeleton about the pores. The boron diffuses rapidly and becomes substantially uniformly distributed throughout the structure. Nickel also diffuses into the iron, but, because of the relatively slow diffusion rate, nickel diffusion is limited to the iron region immediately about the pores. Copper, if added, also melts and diffuses into the iron structure to produce desired dimensional and strengthening effects, but is believed to act in a conventional manner independent of the nickel boride additive of this invention.

At the elevated sintering temperature, the iron alloy exists in the austenite phase. Upon gas cooling of the sintered structure, the bulk of the structure transforms to pearlite. However, the nickel diffused into the iron region about the pores is effective to stabilize the austenite there so that the austenite is retained in the cooled microstructure. During subsequent deformation, this retained austenite may undergo transformation to martensite, resulting in increased plasticity in the metal about the pores. This transformation-induced plasticity improves the resistance of the metal about the pores to crack initiation and propagation, thereby improving the mechanical properties exhibited by the product.

In an example of a preferred embodiment of this invention, an article is formed from a powder mixture comprising, by weight, about 96 parts plain iron powder, about 1.0 parts nickel boride compound, about 2.0 parts copper powder and about 1.0 parts graphite powder. The iron powder is a low-carbon (0.01 weight percent maximum) commercial grade material sized to −60 mesh. The graphite is synthetic commercial powder available from the Joseph Dickson Crucible Company, New Jersey, under the trade designation KS-2, and having particle sizes between about 2 and 5 microns. The metallic copper powder comprises high purity flakes sized to -325 mesh. The nickel boride powder is composed substantially of intermetallic compound NiB and contains about 14.8 percent boron, the balance nickel and impurities. The addition results in a nickel concentration in the sintered product of about 0.85 weight percent. Nickel boride is extremely brittle and is readily fragmented to a -400 mesh powder. The various powders were combined and blended into a uniform mixture.

The powder mixture is then placed into a die. Prior to filling, the die is coated with a butyl stearate lubricant. The powder mixture is compacted within the die to form a green compact having a density of 7.00 grams per cubic centimeter. In this example, the die cavity was sized and shaped to produce an ASTM Standard #8-78 flat, unmachined powder metal tensile bar having a 25 millimeter gauge length. However, the invention is not limited to producing tensile bars, but rather the die cavity may be suitably sized and shaped to produce a part of a desired design, such as a gear.

The green compact is heated within a vacuum furnace in two steps. The furnace is evacuated to a pressure of about $8\times10^{-2}$ torr, whereafter the compact is heated to about 500° C. for a time, approximately one-half hour, sufficient to vaporize the lubricant. After the lubricant has vaporized, indicated by stabilization of the pressure, the furnace temperature is increased to 1120° C. for sintering. The compact is maintained at the sintering temperature for about one-half hour. The sintered compact is then removed from the furnace hot zone and cooled to room temperature while exposed to convective dry nitrogen gas.

A series of tensile bars was prepared in accordance with the described embodiment, but containing varying amounts of nickel boride additive. The strength and ductility of the tensile bar was determined in accordance with the tensile test designated ASTM Standard E8. Testing was carried out on an Instrom testing machine. In accordance with the usual practice, the bar was gripped at opposite ends and pulled at a crosshead speed of 0.5 millimeter per minute. Elongation was measured using a spring loaded high-gain extensometer with a 25 millimeter gauge length. A stress-strain curve was generated by plotting the extensometer measurement as a function of the applied load. The area under the curve indicates the toughness of the bar under test.

To evaluate the effect upon toughness of the nickel boride addition made in accordance with this invention, the area of the stress-strain curve for a sample bar was compared to that for a reference bar formed of a similar iron-copper-carbon mixture but without a nickel addition. It was found that, for small additions of nickel boride, the relative toughness increased as a function of the overall nickel concentration. An addition of 0.4 weight percent nickel, added as nickel boride, produced a toughness 1.4 times that of the nickel-free reference, representing a significant 40 percent improvement. Nickel concentrations between about 0.8 and 0.9 weight percent resulted in a toughness of more than double the reference material. The improvement in toughness was significantly reduced at nickel concentrations greater than about 1.0 percent. Essentially no toughness benefit was obtained at nickel concentrations greater than about 2 percent. In general, an increase in relative toughness of greater than 50 percent was obtained at nickel concentrations within a preferred range between about 0.5 and 1.0 weight percent, with the maximum improvement being obtained between about 0.8 and 0.9 weight percent.

Microstructures of the sintered products formed with nickel boride additions in accordance with the described embodiment were also examined. The principal portion of the iron alloy skeletal structure exhibited a fine pearlite matrix microstructure. However, regions of retained austenite were found encircling pores in the sintered structure. No similar retained austenite was observed in the microstructure of comparable nickel-free material. In general, the proportion of retained austenite was found to increase with increased nickel concentration. This trend continued for nickel concentrations greater than 1 or 2 percent, even though, for reasons not fully understood, the improvement in toughness was reduced. The localized nickel concentration in the austenite region about the pores was found to range between about 12 to 18 percent. Nickel concentrations within this range are known to be sufficient to stabilize austenite at room temperature. Essentially no metallic nickel or copper residue was found on pore surfaces.

In the described embodiment, the sintered structure was formed of plain iron, infused with carbon and nickel, and slowly cooled to produce a predominantly pearlitic microstructure. Alternately, after sintering, the hot structure may be quenched in oil or water to produce a majority of a martensite microstructure having increased hardness for enhanced wear resistance, while retaining the nickel-enriched austenite regions about the pores for improved toughness. In general, the method of this invention is suitable for forming structures from iron powder formed of plain iron metal or iron alloy having a low carbon content. In another embodiment, nickel boride compound may be suitably added to improve mechanical properties of a structure formed of low-carbon prealloyed iron powder. For example, a powder formed of an alloy consisting of about 0.5 weight percent molybdenum, about 1.8 weight percent nickel and the balance iron may be blended with graphite powder and nickel boride powder, compacted, sintered and convective gas cooled. The nickel concentration in the base powder alloy is not adequate to stabilize austenite. Upon cooling, a structure is formed that is mainly martensite. However, nickel diffusion from the boride into regions about the pores increases the concentration sufficient to retain the austenite in the product and thereby improve mechanical properties.

In the preferred embodiment, nickel boride is employed as a vehicle for adding nickel to the powder mixture in a form effective to enhance nickel diffusion during sintering. It is desired that the nickel additive form a transient liquid phase during sintering. This liquid phase distributes the nickel on the pore surfaces and promotes nickel diffusion into the iron. Metallic nickel does not form a liquid phase at the described iron sintering temperatures because of its relatively high melting point, so that diffusion into the iron about the pores is limited and insufficient to produce a concentration effective to stabilize the austenite. During sintering, boron diffuses rapidly and uniformly throughout the iron and is believed to have a minimal effect upon the bulk microstructure or properties, although boron may enhance retention of the austenite fraction.

In the described embodiments, the powder mixture contains an effective carbon addition to produce a predominantly pearlitic microstructure. In general, the carbon addition should be sufficient to assure a hypereutectoid carbon concentration throughout the structure to avoid formation of soft ferrite that reduces mechanical properties. In addition, excess carbon may be needed to compensate for loss during vacuum sintering. In the described embodiment, it is estimated that approximately 0.03 to 0.04 weight percent carbon is lost during the vacuum sintering process. In general, an addition of between about 0.7 and 1.0 weight percent carbon is suitable. An excessive carbon addition may result in localized liquid formation and distortion of the structure.

Although not essential to the practice of this invention, the powder mixture preferably contains copper. During sintering, copper melts and diffuses in the iron. The copper tends to concentrate about pores and along grain boundaries because of a relatively slow diffusion rate. This copper addition is preferred to compensate for shrinkage of the iron during sintering and thus reduce distortion in the product. Also, copper precipitation hardens the iron to strengthen the structure. It is believed that the copper addition acts independently from, and is not affected by, the nickel boride addition of this invention. In general, a metallic copper addition of between 2 and 3 weight percent is preferred. An excessive copper addition may result in formation of unwanted liquid phase and distortion of the product structure.

In the described embodiment, the green compact is sintered within a vacuum furnace to minimize oxidation not only of the principal metals, but also of the boron. Sintering may be carried out by any suitable practice that minimizes contact with oxidizing species. For example, the compact may be suitably sintered while exposed to a reducing atmosphere, a cracked ammonia atmosphere, a hydrogen atmosphere, or a dry inert gas atmosphere. In addition, a suitable sintering atmosphere may be derived from a hydrocarbon source such as methanol or propane. For compacts containing copper, such as in the preferred embodiment, sintering may be suitably carried out at a temperature above 1083° C., the melting point of copper. However, a temperature above 1100° C. is desired to enhance iron diffusion bonding. Above 1150° C., distortion of the structure during sintering is increased. A sintering temperature between 1110° C. and 1120° C. is preferred. It is desired that the sintering time be sufficient to diffusion bond the iron particles into a suitably cohesive structure and diffuse the several additives into the iron lattice. For sintering temperatures within the preferred range, sintering times between about 15 and 35 minutes produce satisfactory structures.

In the described embodiment, lubricant was applied to the die prior to compacting. Optionally, a vaporizable lubricant may be added to the powder mixture prior to compaction. Commercial lubricants of the type composed of a vaporizable hydrocarbon wax are preferred for blending with the powder mixture prior to vacuum sintering.

While this invention has been described in terms of certain embodiments thereof, it is not intended that it be limited to the above description but rather only to the extent set forth in the claims that follow.

The embodiments of the invention in which an exclusive property or privilege is claimed are defined as follows:

1. A method for forming a cohesive article from iron powder comprising compacting a powder mixture comprising a suitable low-carbon iron powder, carbon powder in an amount effective for diffusion into the iron mass to produce a carbon content suitable to form a pearlitic or martensitic microstructure, and a powder composed of a nickel boron compound suitable for forming a liquid phase at iron sintering temperatures, sintering the powder compact at a temperature and for a time effective to diffusion bond the iron into an integral structure having pores, to diffuse carbon into the iron structure, to cause said nickel boron to form a transient liquid phase that wets pore surfaces, and to diffuse nickel and boron from said liquid phase into the iron structure, said nickel diffusion being limited to regions about the pores that are austenitic at said sintering temperature, and cooling the sintered structure to form the article, whereupon a major portion of the iron alloy structure transforms to a pearlitic or martensitic microstructure, but whereupon the nickel-enriched iron alloy regions about the pores comprise retained austenite suitable to retard crack formation and thereby enhance mechanical properties of the article.

2. A method for forming a cohesive article that comprises compacting a powder mixture comprising between about 0.7 and 1.0 weight percent graphite powder, between about 2 and 3 weight percent metallic copper powder, a powder composed of intermetallic nickel boride compound in an amount sufficient to produce a nickel content of between about 0.5 and 1.0 weight percent, and the balance substantially low-carbon iron powder, sintering the powder compact at a temperature between about 1100° C. and 1150° C. for a time effective to diffusion bond the iron into an integral structure having pores, to diffuse carbon into the iron structure to produce a substantially uniform hypereutectoid carbon alloy, said alloy being austenitic at the sintering temperature, to liquify the copper and the nickel boride compound to form a liquid phase on pore surfaces, and to diffuse copper, nickel and boron into the iron structure, said nickel diffusion being primarily limited to regions about the pores, and convective gas cooling the iron alloy structure at a rate sufficient to transform a major portion of the structure to a pearlitic microstructure, but to retain the nickel-enriched iron alloy regions about the pores in metastable austenitic phase suitable for transformation to martensite during deformation, whereby said nickel-enriched metastable austenite is effective to retard crack formation and thereby enhance toughness of the produce article.

3. A method for forming a cohesive article comprising compacting and sintering a predominantly iron powder mixture to produce a bonded iron structure, said mixture being composed predominantly of plain iron powder and comprising graphite powder in an amount effective to produce in combination with the iron a hypereutectoid carbon alloy in the iron structure, metallic copper powder in an amount effective to reduce dimensional distortion and strengthen the iron structure, and an amount of a powdered nickel boride compound sufficient to produce a nickel concentration between about 0.5 and 1.0 weight percent, said sintering being carried out at an effective temperature to diffuse carbon, copper, nickel and boron into the iron structure and to form an austenitic microstructure at said temperature, said nickel diffusion being primarily limited to regions of said structure about pores therein and being effective to stabilize said austenite microstructure in said region such that said austenite is retained upon cooling in the product article.

* * * * *